US011634904B2

(12) United States Patent
Cudicio

(10) Patent No.: US 11,634,904 B2
(45) Date of Patent: Apr. 25, 2023

(54) SOUNDPROOF FUME DISCHARGE CONDUIT

(71) Applicant: DANIELI & C. OFFICINE MECCANICHE S.P.A., Buttrio (IT)

(72) Inventor: Marco Peter Cudicio, Conegliano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 191 days.

(21) Appl. No.: 17/069,192

(22) Filed: Oct. 13, 2020

(65) Prior Publication Data

US 2021/0108407 A1 Apr. 15, 2021

(51) Int. Cl.

| | |
|---|---|
| ***F24F 13/24*** | (2006.01) |
| ***F27D 21/00*** | (2006.01) |
| ***E04B 1/84*** | (2006.01) |

(52) U.S. Cl.

CPC ..... *E04B 1/84* (2013.01); *F24F 13/24* (2013.01); *E04B 2001/8485* (2013.01); *F24F 2013/242* (2013.01)

(58) Field of Classification Search

CPC ..... F24F 13/24; F24F 2013/242; E04B 1/84; E04B 2001/8414; F01N 1/24; F23J 13/00; F23J 13/06; F23J 13/08; F23J 2900/13003; F23L 17/00; F27D 21/00; F27D 2021/0057; F27D 2021/0064

See application file for complete search history.

(56) References Cited

U.S. PATENT DOCUMENTS

| | | | | | |
|---|---|---|---|---|---|
| 1,832,741 | A | * | 11/1931 | Sersen | G10K 11/16 181/292 |
| 4,303,144 | A | * | 12/1981 | Wirt | F24F 13/24 181/292 |
| 4,356,880 | A | * | 11/1982 | Downs | E04B 1/99 52/630 |
| 5,449,499 | A | * | 9/1995 | Bauer | B01D 53/8631 422/177 |
| 6,059,070 | A | | 5/2000 | Cudicio et al. | |

(Continued)

FOREIGN PATENT DOCUMENTS

| | | | | |
|---|---|---|---|---|
| CN | 108006681 | A | 5/2018 | |
| DE | 4233312 | A1 * | 4/1994 | F04D 29/664 |

(Continued)

OTHER PUBLICATIONS

Ministero Dello Sviluppo Economico, Italian Search Report and Written Opinion for Italian Application No. 201900018695, dated Jun. 10, 2020, 15 pages.

*Primary Examiner* — Edgardo San Martin
(74) *Attorney, Agent, or Firm* — Stetina Brunda Garred and Brucker

(57) ABSTRACT

A soundproof fume discharge conduit adapted to be arranged between a ventilation system and an outlet chimney, the conduit defining a fume path therein, wherein at least one side surface of the conduit is provided with at least two protrusions, each protrusion internally defining a respective step-shaped recess, whereby the path is provided with at least two step-shaped recesses adapted to reflect sound waves propagating along the path, and wherein the step shape of each recess is defined by two first walls, which are incident at a first end thereof, and at least one wall of the two first walls is coated with a first sound absorbing material.

19 Claims, 5 Drawing Sheets

(56) References Cited

U.S. PATENT DOCUMENTS

| | | | | |
|---|---|---|---|---|
| 6,216,691 | B1 * | 4/2001 | Kenyon | F04D 29/663 128/205.18 |
| 6,290,022 | B1 * | 9/2001 | Wolf | G10K 11/172 181/295 |
| 6,568,135 | B1 * | 5/2003 | Yokoyama | E01F 8/0094 181/290 |
| 8,087,491 | B2 * | 1/2012 | Merchant | F01D 25/30 181/224 |
| 9,290,274 | B2 * | 3/2016 | Roach | F02C 7/045 |
| 2020/0193953 | A1 * | 6/2020 | Gurvich | G10K 11/172 |

FOREIGN PATENT DOCUMENTS

| | | | | | |
|---|---|---|---|---|---|
| DE | 9316608 | U1 | | 2/1995 | |
| DE | 202007017770 | U1 | | 4/2009 | |
| FR | 2793825 | A1 | * | 11/2000 | E04B 1/84 |
| JP | H1082505 | A | * | 3/1998 | F23C 11/00 |
| JP | 2013193698 | A | * | 9/2013 | |

* cited by examiner

SOUNDPROOF FUME DISCHARGE CONDUIT

CROSS-REFERENCE TO RELATED APPLICATIONS

This application claims priority to Italian Patent Application No. 102019000018695 filed on Oct. 14, 2019, the disclosure of which is expressly incorporated herein by reference.

STATEMENT RE: FEDERALLY SPONSORED RESEARCH/DEVELOPMENT

Not applicable.

FIELD OF THE INVENTION

The present invention relates to a soundproof fume discharge conduit, which is particularly suitable to be connected to an outlet chimney of a fume suction line, adapted to be positioned, for example, in a steel plant. More specifically, such a conduit is designed to soundproof the delivery of the fans connected to the outlet chimneys for discharging fumes into the environment, said outlet chimneys being associated with melting systems.

BACKGROUND ART

Fume discharge conduits are known in the art, through which the fumes generated by the steel plants comprising melting systems, such as for example electric furnaces, are discharged into the environment upon passage through suitable filtration systems.

The fumes are directed to the discharge conduits by means of specific ventilation and conveying systems which cooperate with the chimney.

It is known that conveying fumes by the ventilation systems causes a high level of noise, which is usually obviated by soundproofing systems associated with the discharge conduits.

It is known in the field of steel to coat the interior of the discharge conduits with sound absorbing panels formed by a plurality of partitions placed side-by-side generally made of mineral wool or material having similar properties.

However, said sound absorbing panels are subject to early wear due to the sound waves and the aerodynamic fluctuations. Moreover, over time they have the drawback of releasing fibers, dust or particles having various granulometry into the environment. Therefore, a further and often significant secondary pollution is generated. In particular, health problems may arise when the mineral wool (e.g. glass wool) is employed as a sound absorbing material. Indeed, the potentially carcinogenic micro mineral wool fibers may be inhaled.

Such air dispersion into the environment also causes a progressive thinning of the sound absorbing layer and therefore a substantial reduction of the sound absorbing power of the panel.

This results in the need for frequent maintenance operations, aiming both to maintain the sound absorbing effect of the sound absorbing panels and to avoid the diffusion of pollutants into the environment.

A known solution to dampen the sound waves provides orienting the conduits according to a single elbow curve having a right angle. This geometry is associated with side walls made of sound absorbing material not subject to air dispersion or even parallel partitions of said material arranged in the inner volume of the conduit. However, although performing from a noise reduction viewpoint, this solution has considerable problems of loss of load in transporting the gas through the chimney, this due to the broad angle used to bend the conduit.

In order to bring down the level of noise propagated over long distances, another known solution provides raising the frequencies which are typical of fans by implementing a greater number of blades or implementing fans having dual impeller with blades staggered by half a step. However, this solution results in an increased cost of the machines and also an increased operating cost should the aeraulic performance of the fans be lower.

Thus, the need is felt to overcome the stated drawbacks.

SUMMARY OF THE INVENTION

It is an object of the present invention to provide a soundproof fume discharge conduit capable of increasingly reducing the sound emissions without compromising the flow rate of the fumes.

It is another object of the present invention to provide a soundproof fume discharge conduit which is simple to build, while keeping low the installation costs.

The present invention achieves at least one of such objects, and other objects which will become apparent in light of the present description, by a soundproof fume discharge conduit according to claim 1, adapted to be arranged between a ventilation system and an outlet chimney, the conduit defining a fume path therein;

wherein at least one side surface of the conduit is provided with at least two protrusions, each protrusion internally defining a respective step-shaped recess, whereby the path is provided with at least two step-shaped recesses adapted to reflect sound waves propagating along the path;

wherein the step shape of each recess is defined by two first walls, which are incident at a first end thereof, and at least one wall of the two first walls is coated with a first sound absorbing material.

The invention also relates to a fume outlet chimney of a steel plant according to claim 13, said chimney being connected, in particular at the bottom, to at least one fume discharge conduit.

The conduit of the invention advantageously allows an increased reduction of the sound emissions to be obtained without negatively altering the flow rate of the gases or fumes and without simultaneously increasing installation costs.

In particular, the conduit of the invention also allows the low frequencies to be adequately soundproofed, which are those which are conventionally propagated at long distances, having practically zero dissipations in the free air. Therefore, it is not required to raise the characteristic frequencies of fans, whereby the costs and dimensions are curbed.

Advantageously, there is a synergetic effect given by the plurality of step-shaped recesses of the inner wall of the conduit, which allow the rebounding principle of sound waves to be utilized, in addition to the increased sound absorbing power due to the walls forming the steps being provided with dissipative material, preferably not subject to air dispersion, for example expanded clay.

The sound waves generated by the fans of the fume suction line are absorbed and/or reflected by the inner steps in an optimal manner.

The upward waves advantageously have a gradually decreasing intensity with respect to the initial waves generated by the fans, according to the height thereof.

A sound absorbing perforated sheet panel can suitably be installed to increase the noise reduction effect. In particular, the panel is positioned so as to delimit areas or cavities together with the inner walls forming each step.

Preferably, for each area or surface provided with steps the latter are substantially arranged in series, for example the steps are arranged in series along an axis.

Preferably, in addition to the series or group of steps of the upper surface of the discharge conduit, in some embodiments also one or more other surfaces or portions of surfaces of the conduit are provided with a series of steps, each series preferably comprising at least two steps.

The steps preferably have relatively small sizes so as not to have substantial decreases in the flow rate of fluid to the chimney, therefore avoiding undesired losses of load.

At least one of the steps (for example all the steps) preferably has a width and height less than the width of the conduit, preferably less than half the average diameter of the conduit, or less than half the width thereof in the event of polygonal conduits. The width of the step and the width of the conduit are preferably measured along a same axis. The width of the step and the height of the step are transversal to each other, for example orthogonal to each other.

When one or more conduits are connected to the chimney, the steps preferably extend, in particular, radially outward with respect to the chimney.

Further features and advantages of the invention will become more apparent in light of the detailed description of non-exclusive embodiments.

The dependent claims describe particular embodiments of the invention.

BRIEF DESCRIPTION OF THE FIGURES

The description of the invention relates to the accompanying drawings, which are provided by way of non-limiting example, in which.

The same reference numerals in the drawings identify the same elements or components, or similar elements or components.

DESCRIPTION OF EMBODIMENTS OF THE INVENTION

With reference to the drawings, some examples are described of a fume discharge conduit 1 according to the invention.

Figure 3:
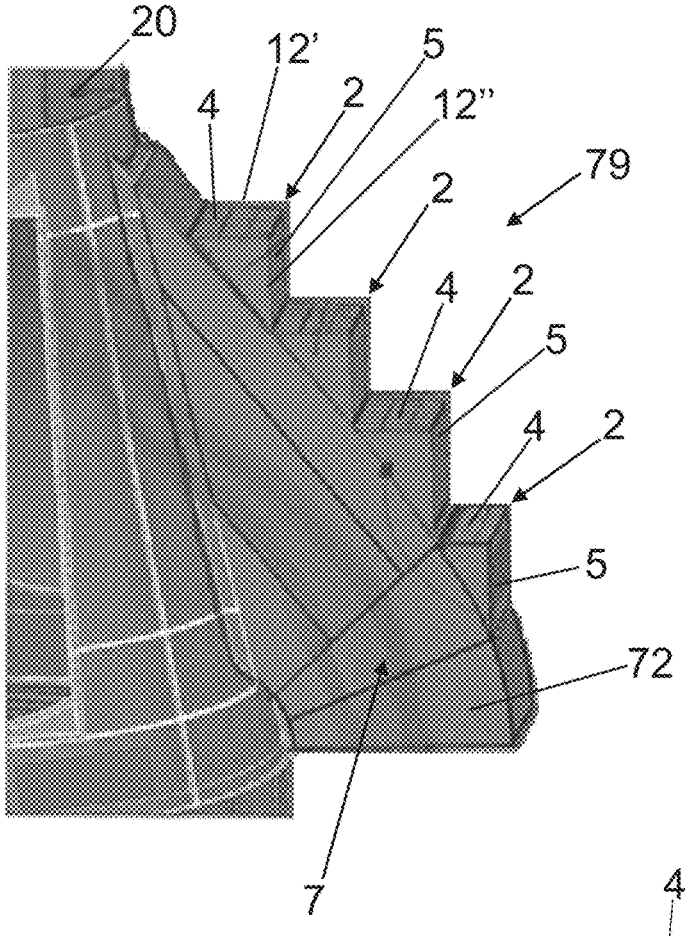
FIG. 3 shows a perspective view of part of a second embodiment of the conduit of the invention, connected to a chimney.
Figure 4:
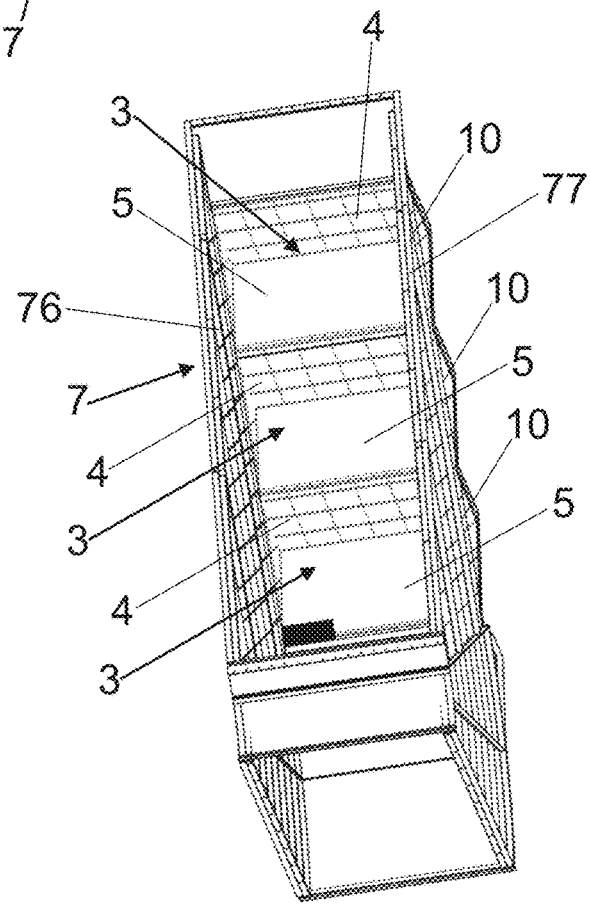
FIG. 4 shows a perspective view of the conduit shown in FIG. 3.
Figure 5:
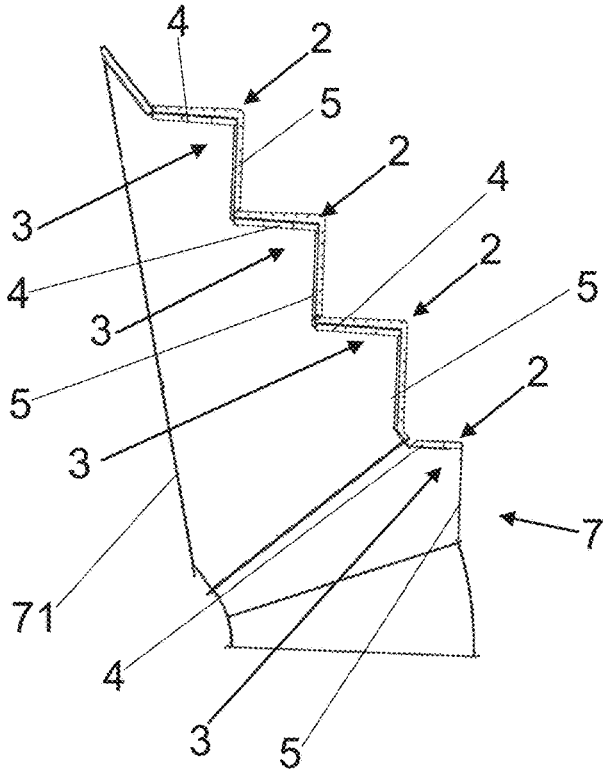
FIG. 5 diagrammatically shows a section of the conduit in FIG. 3.

The fume discharge conduit 1 is soundproof and is adapted to be arranged between a ventilation system (not shown) and a chimney 20 (partially shown in FIG. 3).

The conduit 1 is particularly adapted to be connected to the ventilation system and to the chimney 20. One or more conduits 1, for example one, two, three or four conduits 1, can be connected to the chimney 20. The conduit 1 comprises an inlet section 61, through which the fumes are emitted into conduit 1, and an outlet section 71, from which the fumes leave the conduit 1 to be introduced into the chimney 20.

In particular, the conduit 1 is a suction branch of the chimney 20.

In all the embodiments of the invention, the conduit 1 defines a fume path therein, and at least one side surface of conduit 1 is provided with at least two protrusions 2. Each protrusion 2 internally defines a respective step-shaped recess 3, whereby the path is provided with at least two step-shaped recesses 3. The step-shaped recesses 3 are advantageously adapted to reflect sound waves, in particular generated by the ventilation system, which propagate along the fume path defined by the conduit 1.

Figure 10:
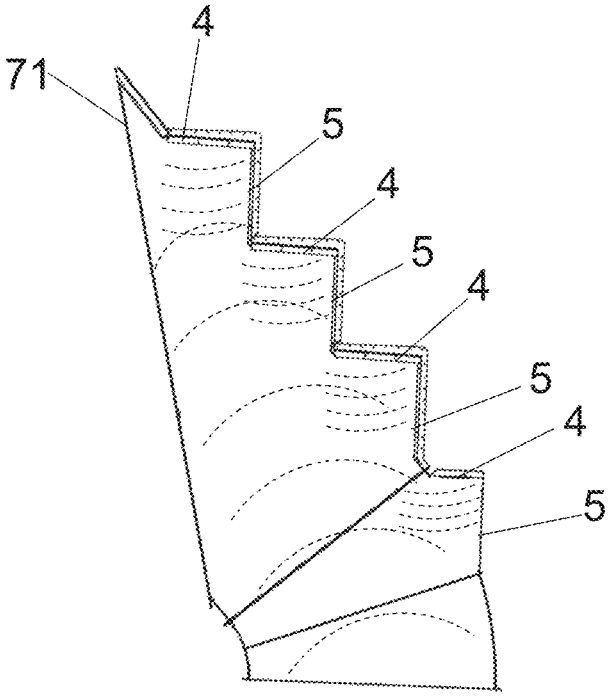
FIG. 10 shows the view in FIG. 5, with a diagrammatic depiction of the reflection of the sound waves along the conduit of the invention.

FIG. 10 diagrammatically shows the upward sound waves and the sound waves which are advantageously absorbed and/or reflected by the steps 3, in particular by the walls 4 and/or by the walls 5.

Figures 1, 2:
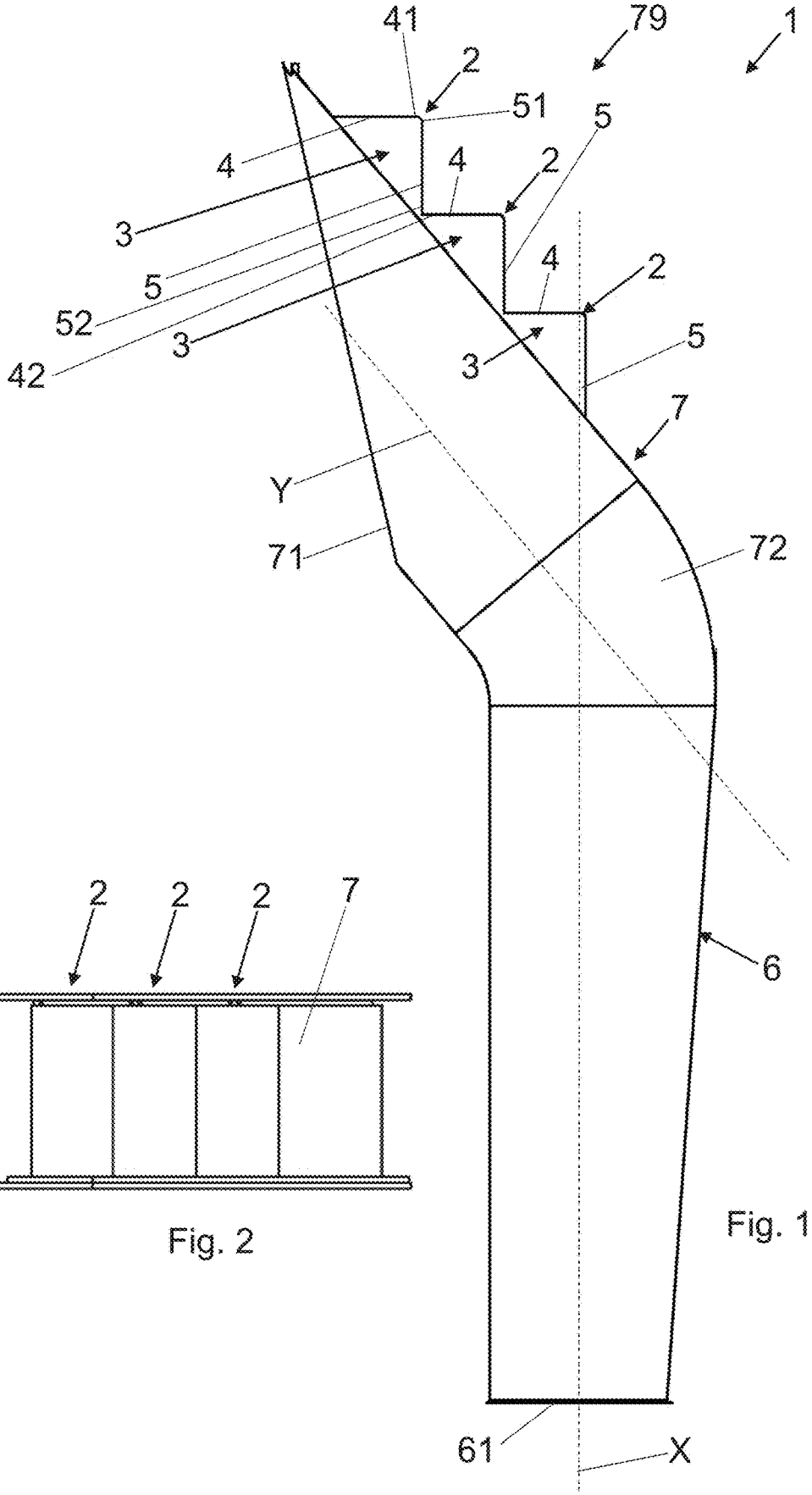
FIG. 1 shows a diagrammatic side view of a first embodiment of the conduit according to the invention.
FIG. 2 shows a top view of the conduit in FIG. 1.

The step shape of each recess 3 indeed is defined by two walls 4, 5 (also called first walls) which are incident at a first end thereof 41, 51 (FIG. 1). For each recess 3, also called step 3, at least one wall of the two walls 4, 5 is coated with a sound absorbing material. In other words, the wall 4 and/or the wall 5 are coated with sound absorbing material. In particular, the surface, inside the conduit 1, of the wall 4 and/or of the wall 5 is coated with sound absorbing material.

The sound absorbing material preferably comprises or consists of expanded clay, in particular expanded clay granules, or steel wool or mineral wool or polyester fluff.

For each recess 3, the end 41 of the wall 4 is preferably joined, in particular directly joined, to the end 51 of wall 5.

More generally, the recesses 3 preferably are consecutive to one another, preferably adjacent to one another.

According to the number of protrusions 2, at least one wall 5 of one protrusion 2 is preferably joined to a respective wall 4 of the consecutive protrusion 2.

In particular, for each recess 3, the wall 4 and the wall 5 are mutually inclined. The wall 4, with wall 5, forms an angle, for example but not exclusively equal to about 90°. Preferably, but not exclusively, the walls 4 are parallel to one another and/or the walls 5 are parallel to one another.

Preferably, said at least two protrusions 2 are externally step-shaped.

With particular reference to FIG. 1, the conduit 1 comprises two mutually inclined stretches 6, 7. In particular, the two stretches 6, 7 are joined to each other by a connecting stretch 72 which is preferably curved. The connecting stretch 72 preferably is a portion of the stretch 7.

The stretch 6 of the conduit 1 is adapted to be connected to the ventilation system. The inlet section 61 of the conduit 1 is preferably delimited by the stretch 6.

The stretch 6 defines a longitudinal axis X. The longitudinal axis X preferably crosses the inlet section 61.

The stretch 7 of the conduit 1 is adapted to be connected to the outlet chimney 20. In particular, the outlet section 71 of the conduit 1 is preferably delimited by the stretch 7.

The stretch 7 defines a longitudinal axis Y, which is inclined with respect to the longitudinal axis X of the stretch 6. The longitudinal axis Y preferably crosses the outlet section 71.

At least the upper surface 79 of the stretch 7 is provided with at least two protrusions 2, for example three protrusions 2, as shown in FIG. 1, or four protrusions 2, as shown in FIGS. 3, 4, 5, 6, 8, 9, 10, in which the fourth protrusion preferably is at the upper surface of the connecting stretch 72.

The upper surface 79 of the stretch 7 is, in particular, the surface which is distal from the chimney 20 when the conduit 1 is connected to the chimney 20. Preferably, at least part of the upper surface 79 is substantially opposed to the outlet section 71.

The protrusions 2 are preferably arranged in sequence, for example in sequence substantially along the axis Y.

The stretch 7 preferably has a circular or polygonal cross-section. The cross-section of the stretch 7 can, for example, be substantially quadrangular, in particular in the variants shown in FIGS. 8 and 9.

Figure 8:
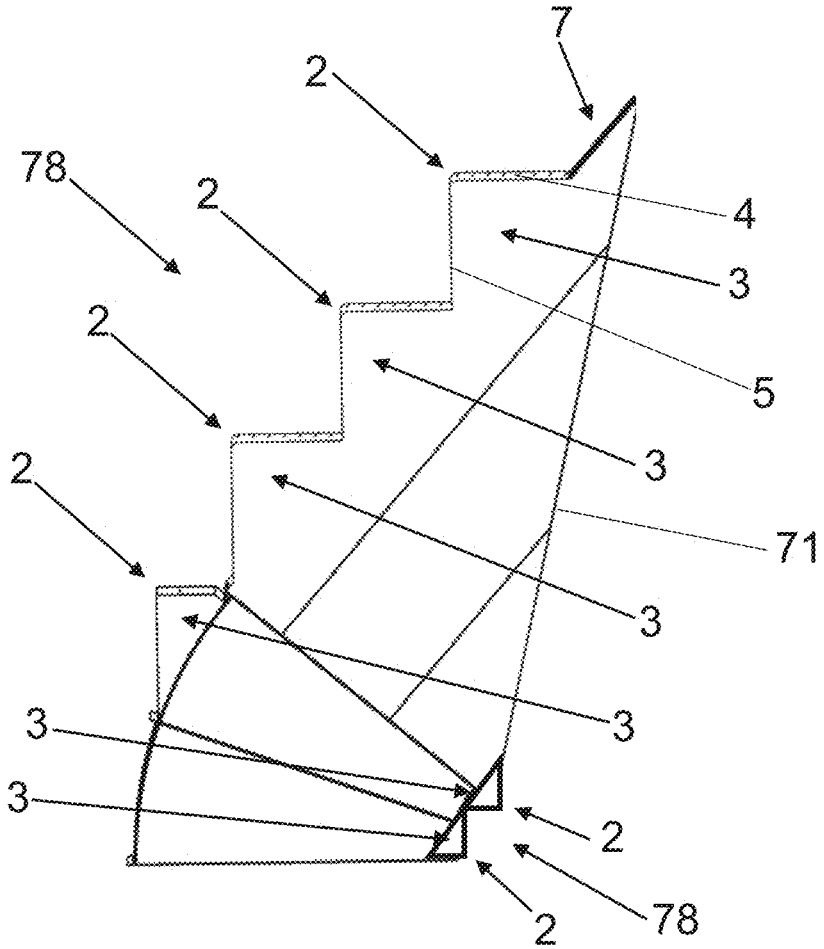
FIG. 8 diagrammatically shows a section of another variant of a conduit according to the invention.

FIG. 8 shows a variant in which also the lower surface 78 of the stretch 7 is provided with protrusions 2, for example two protrusions 2.

The lower surface 78 preferably is close to, for example adjacent to, the outlet section of the conduit 1.

In the variant shown in FIG. 8, each protrusion 2 internally defines a respective step-shaped recess 3, substantially as described above. The protrusions 2 protrude outward so as not to substantially alter the flow rate of the fumes.

Figure 9:
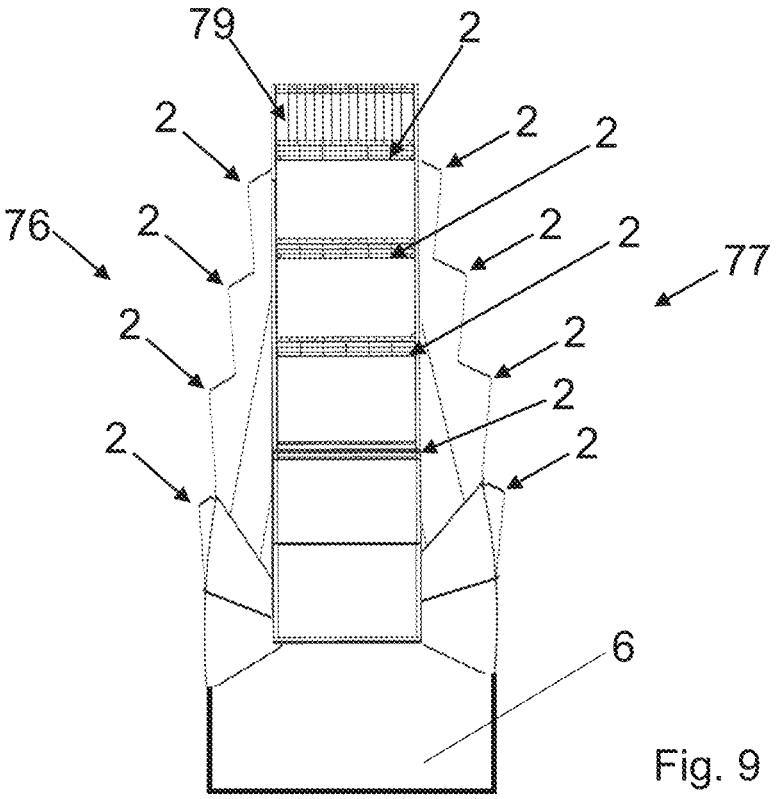
FIG. 9 diagrammatically shows a section of another variant of a conduit according to the invention.

In the variant shown in FIG. 9, in addition to the upper surface 79, also the side surface 76 and the side surface 77 of the conduit 1 are each provided with at least two protrusions 2. Each protrusion 2 of the side surfaces 76, 77 internally defines a respective step-shaped recess 3, substantially as described above.

For example, four protrusions 2 are provided for each side surface 76, 77. The side surface 76 and the side surface 77 preferably are opposite to each other.

Figure 6:
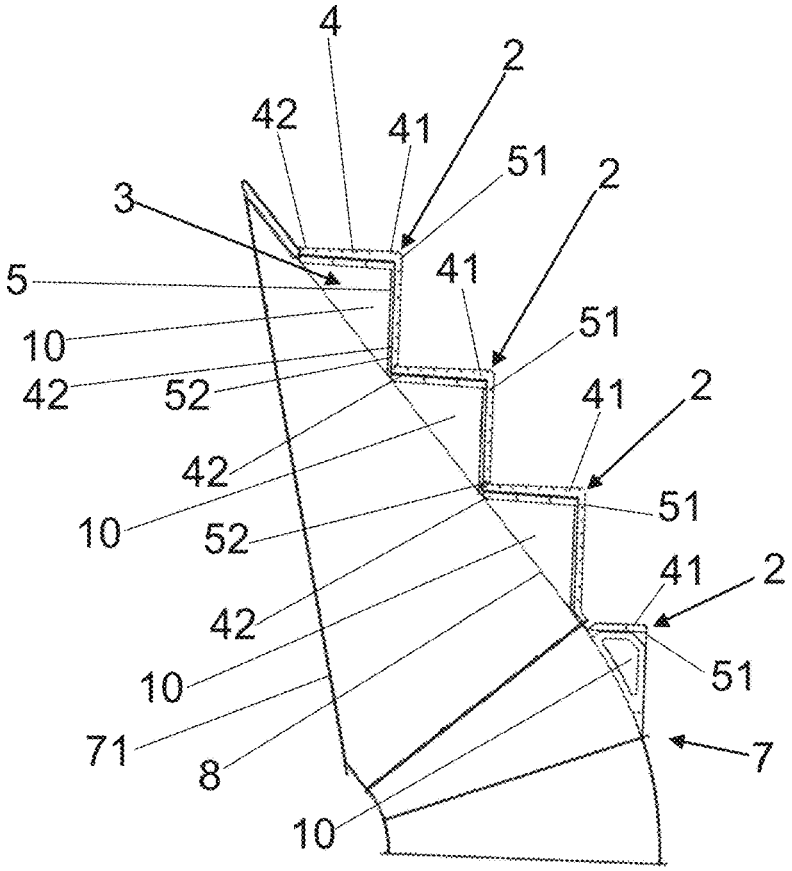
FIG. 6 diagrammatically shows a section of a variant of a conduit according to the invention.

In all the embodiments, a panel 8 (FIGS. 6 and 7) to improve the soundproofing is preferably included, the panel being provided with a plurality of holes 9, in particular through holes, and resting on second ends 42, 52 of the two first walls 4, 5, opposed to the first ends 41, 51, thus delimiting the volume of the step-shaped recess 3 together with two second side walls 10 which are parallel to each other and transversal, e.g. orthogonal, to the walls 4, 5. FIG. 6 shows only one of the two walls 10 for each step-shaped recess 3.

Figure 7:
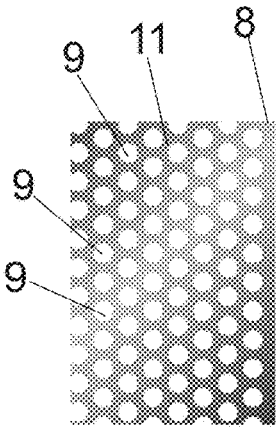
FIG. 7 shows a top plan view of part of a component of the conduit shown in FIG. 6.

In the variant shown in FIGS. 6 and 7, the panel 8 particularly rests on the ends 42, 52 of the steps 3 of the upper surface 79 of conduit 1.

The panel 8 is preferably made of metal, in particular metal sheet. The metal sheet is preferably coated with a sound absorbing material. The sound absorbing material preferably comprises or consists of expanded clay, in particular expanded clay granules, or steel wool or mineral wool or polyester fluff. The sound absorbing material can be the same sound absorbing material with which the walls 4 and/or 5 are coated or a different sound absorbing material.

To obtain better soundproofing performance, the panel 8 preferably has a percentage ratio of the area of the plurality of holes 9 (intended as the sum of the areas of holes) to the area of the solid part 11 of the panel 8 which is less than 50%, preferably from 25 to 35%.

A single panel 8 is preferably provided resting on the second ends 42, 52 of the two walls 4, 5 of each step-shaped recess 3.

As already mentioned, the stretch 7 of the conduit 1 preferably has a circular or polygonal cross-section, for example a quadrangular cross-section. In order to improve the soundproofing without affecting the flow rate of the fumes, both walls 4, 5 of at least one step-shaped recess 3 (for example, of all the step-shaped recesses 3) preferably have a respective first side 12', 12" (FIG. 3) with a length less than the average diameter, preferably less than half the average diameter, of the stretch 7 (when the latter has a circular cross-section), or less than the width, preferably less than half the width, of the stretch 7 (when the latter has polygonal cross-section).

When the stretch 7 of the conduit 1 has a quadrangular cross-section, both walls 4, 5 of at least one step-shaped recess 3 preferably have said first side 12', 12" with a shorter length than the width of the stretch 7, preferably less than half the width of the stretch 7, and preferably a second side with a length substantially equal to the width of the second stretch 7. The side 12' of the wall 4 preferably defines the depth of the step 3, and the side 12" of the wall 5 preferably defines the height of the step 3, or of the protrusion 2.

The invention also relates to a fume outlet chimney 20 of a steel plant, the chimney 20 being connected, in particular at the bottom or at the side, to at least one fume discharge conduit 1, for example one, two, three, four or more conduits 1.

What is claimed is:

1. A steel plant comprising a fume outlet chimney, said outlet chimney being connected to at least one soundproof fume discharge conduit, said conduit being arranged between a ventilation system and said outlet chimney and defining a fume path therein, wherein at least one side surface of the conduit is provided with at least two protrusions, each protrusion internally defining a respective step-shaped recess, whereby the path is provided with at least two step-shaped recesses adapted to reflect sound waves propagating along the path, wherein the step shape of each recess is defined by two first walls, which are incident at a first end thereof, and at least one wall of the two first walls is coated with a first sound absorbing material.

2. The plant according to claim 1, wherein said at least two protrusions are externally step-shaped.

3. The plant according to claim 1, wherein there are provided a first stretch of the conduit, defining a first longitudinal axis X and adapted to be connected to the ventilation system, and a second stretch of the conduit defining a second longitudinal axis Y inclined with respect to the first longitudinal axis X and adapted to be connected to the outlet chimney; and wherein said at least one side surface of the conduit is an upper surface of the second stretch.

4. The plant according to claim 3, wherein said at least two protrusions are also provided on a lower surface and/or on side surfaces of the second stretch.

5. The plant according to claim 1, wherein a panel is included, provided with a plurality of holes and resting on second ends of the two first walls, opposed to the first ends, thus delimiting a volume of the step-shaped recess together with two second side walls which are parallel to each other and transversal to said two first walls.

6. The plant according to claim 5, wherein a single panel is provided resting on the second ends of the two first walls of each step-shaped recess.

7. The plant according to claim 5, wherein said panel is made of metal sheet coated with a second sound absorbing material.

8. The plant according to claim 5, wherein said panel has a percentage ratio of area of the plurality of holes to area of a solid part of the panel which is less than 50%.

9. The plant according to claim 7, wherein said second sound absorbing material is selected from the following: expanded clay; steel wool; mineral wool.

10. The plant it-according to claim 3, wherein the second stretch of the conduit has a circular or polygonal cross-section; and wherein both the first walls of at least one step-shaped recess have a first side with a shorter length than half of an average diameter of the second stretch in the case of a circular section or than half of a width of the second stretch in the case of a polygonal section.

11. The plant according to claim 10, wherein the second stretch of the conduit has a quadrangular section; and wherein both the first walls of at least one step-shaped recess have said first side with a shorter length than half of the width of the second stretch and a second side with a length which is equal to the width of the second stretch.

12. The plant according to claim 1, wherein said first sound absorbing material is selected from the following: expanded clay; steel wool; mineral wool.

13. A fume outlet chimney of a steel plant, said chimney being connected to at least one fume discharge conduit arranged between a ventilation system and said outlet chimney and defining a fume path therein, wherein at least one side surface of the conduit is provided with at least two protrusions, each protrusions internally defining a responsive step-shaped recess, whereby the path is provided with at least two-step recesses adapted to reflect sound waves propagating along the path, wherein the step shape of each recess is defined by two first walls, which are incident at a first end thereof, and at one wall of the two first walls is coated with a first sound absorbing material.

14. The plant according to claim 4, wherein the second stretch of the conduit has a polygonal section.

15. The plant according to claim 8, wherein said percentage ratio is from 25 to 35%.

16. The plant according to claim 9, wherein said second sound absorbing material is the same as the first sound absorbing material.

17. The plant according to claim 9, wherein said expanded clay is in form of granules.

18. The plant according to claim 12, wherein said expanded clay is in form of granules.

19. The fume outlet chimney according to claim 13, said chimney being connected at the bottom thereof to said at least one fume discharge conduit.

* * * * *